US006925957B2

(12) United States Patent
Schultz

(10) Patent No.: US 6,925,957 B2
(45) Date of Patent: Aug. 9, 2005

(54) TOWER AND SUPPORT

(76) Inventor: James Schultz, 211 Sandy Point La., Lake Zurich, IL (US) 60047

( * ) Notice: Subject to any disclaimer, the term of this patent is extended or adjusted under 35 U.S.C. 154(b) by 0 days.

(21) Appl. No.: 10/730,336

(22) Filed: Dec. 8, 2003

(65) Prior Publication Data

US 2005/0120934 A1 Jun. 9, 2005

(51) Int. Cl.[7] ..... B63B 17/00
(52) U.S. Cl. ..... 114/364; 114/253
(58) Field of Search ..... 114/250, 253, 343, 114/364; 256/59; 280/756

(56) References Cited

U.S. PATENT DOCUMENTS 3,977,654 A * 8/1976 Etherington et al. ..... 256/59
4,171,141 A * 10/1979 Hobrecht ..... 280/756
4,515,393 A * 5/1985 Sauter ..... 280/756
4,527,349 A * 7/1985 Emory, Jr. ..... 43/21.2
4,900,058 A * 2/1990 Hobrecht ..... 280/756
5,052,326 A * 10/1991 Wiggen et al. ..... 114/343
5,669,325 A * 9/1997 Feikema ..... 114/343
5,979,350 A * 11/1999 Larson et al. ..... 114/253
6,044,788 A * 4/2000 Larson et al. ..... 114/253
6,192,819 B1 * 2/2001 Larson et al. ..... 114/253
6,374,762 B1 * 4/2002 Larson et al. ..... 114/253

* cited by examiner

*Primary Examiner*—Lars A. Olson
(74) *Attorney, Agent, or Firm*—Fitch, Even, Tabin & Flannery

(57) ABSTRACT

A support bracket and method for securing and supporting a superstructure for towing persons behind a vehicle such as a boat is disclosed. The support structure has an arcuate face with a length several times that of a tubular member of the superstructure so that the arcuate face provides support over a portion of the tubular member and so that the face mates with the tubular member. The bracket is removably attached and secured to the vehicle and to the superstructure so that it may be removed, or replaced without altering or damaging the superstructure, and so that weld seams are not used. The arcuate face and a second face of the support structure that secures to the boat are set an angle provides a properly erect angle to the superstructure when the bracket, boat, and superstructure are secured.

18 Claims, 3 Drawing Sheets

44
42
12
α
66
62
60
60
62
42
46

TOWER AND SUPPORT

CROSS-REFERENCE TO RELATED APPLICATIONS

This application is related to U.S. Design Pat. Application No. 29/195,185, filed Dec. 8, 2003, entitled "Support."

FIELD OF THE INVENTION

The present invention relates to superstructures for vehicles, and particularly to supports for structures mounted on a vehicle such as a boat used for recreational sports such as water skiing, wakeboarding, kneeboarding, and the like.

BACKGROUND OF THE INVENTION

Vehicles may be used for towing or dragging persons or items. Currently, many types of powered boats are used for watersports such as water skiing and wakeboarding. For many years, watersports involving a person being towed behind a boat were principally equipped with a boat whose stern rose from the water's surface less that the height of an average person, though larger boats may have had a higher-positioned stern. Regardless, the mount for the tow rope was located on the stern rail or some other relatively low point. Consequently, the fluid dynamic and aerodynamic properties of these watersports involved a pulling force provided to the skier in a primarily horizontal direction, parallel to the surface of the water.

Wakeboarding is still a relatively new sport. The sport is similar to waterskiing in that a person, the wakeboarder, is towed by a rope behind a powerboat. Instead of riding a relatively narrowly ski, however, a wakeboarder rides an appropriately titled wakeboard. A wakeboard is much wider than a waterski and typically much shorter. Because of the ergonomics of a wakeboard, it is recognized that the wakeboard creates a significant amount of drag that is transmitted from the wakeboarder through the tow rope to the boat.

Often waterskiing and other such tow-sports involve a boat traveling at a relatively high velocity. As is commonly known, a drag force is directly proportional to the square of the velocity of the body. Therefore, the faster the skier is being towed, the much greater the drag force the skier is exerting on the tow rope and, therefore, to the tow mount.

One way in which this drag has been alleviated is through the use of a tower or superstructure developed principally for wakeboarding purposes. From the tower, a mount is located from which the wakeboarder's tow rope is attached. Specifically, a tower is mounted to the deck or sides of the boat so that the tower rises above the boat, and the tow rope mount is located on the top of the tower thereby providing clearance for the tow rope to move laterally in relation to the boat. More importantly, however, the tow rope is now positioned rising from the horizontal so that, when pulling a wakeboarder or the like, the tow rope is providing a lift to the wakeboarder. Such a lift decreases the drag, reduces the work the wakeboarder must exert against the water, and assists in the performance of stunts and acrobatics.

The design of these recreational boats, the towers, and other accessories, is subject to design criteria of each's function, aesthetic, and ergonomics. More specifically, the function includes that the boat and accessories have to fulfill their purpose, have to be able to withstand the rigors of use where the user may be a professional athlete who requires many hours and days of heavy use on the equipment, and has to survive a marine and outdoor environment. For the tower permanently mounted to the hull and structure of the boat, it would be difficult and possibly deleterious to the boat if the tower needed replacement, much more so if it were frequent replacement. In addition, replacement of only a portion of the tower would be similarly difficult if the tower were a single, unitary construction.

As for aesthetic, wakeboarding is like other so-called 'extreme sports' in that it is predominantly young, energetic people engaged in a relative new trendsetting sport or pastime. One aspect of the aesthetics is that the boat and accessories reflect this attitude. Beyond this, the concept of industrial design is to provide a design whose form also follows its function.

Ergonomics, which in many ways can be restated as simplicity of use, is also a factor. Typically, the tower is a structure built entirely out of tubular metal such as steel pieces. The towers are not fabricated in their first instance as a single item, instead being a number of steel pieces that are welded at the joints. Often, users attach additional accessories to the tower, such as lights, speakers, or devices for mounting and storing items.

One item which can be stored in a device mounted to the tower is the wakeboard or ski or the like. In order to conserve space within the passenger compartment, it is preferred that any on-board wakeboards refrain from hindering the movement of occupants, and that the wakeboards are stored simply and securely, as well as simply removed from storage. Accordingly, wakeboards are often held on the outside portions of the tower.

Accordingly, there is a need for a new tower and tower support design.

SUMMARY OF THE INVENTION

In accordance with one aspect of the present invention, a new improved superstructure for towing is disclosed. The superstructure may be a tower and may include a support bracket. Preferably, the support is for a superstructure mounted to a surface of a vehicle, such as a boat that is used for a towing a person on a surface, such as water, where the superstructure includes a member providing a lift force to the person, and the bracket includes a mounting surface for mounting to the surface of the vehicle, a stanchion face several times the width of the superstructure and for mounting to the superstructure, and a bracket length spanning from the mounting surface to the stanchion face so that the bracket distributes compressive force received along the stanchion face through to the mounting surface. The stanchion face may have an arcuate surface that mates with and mounts to an arcuate portion of the superstructure. The mounting surface and the stanchion face may be set at an angle to provide a proper positioning of the superstructure being supported. The support preferably is removably installed so that it can be removed or replaced without altering the superstructure. To accomplish this, the support is preferably provided with bolts and bolt holes for securing the support to the boat and to the superstructure.

In accordance with a second aspect of the present invention, a support bracket in combination with a boat having a stern, a bow, two midship points, and a tubular superstructure where the superstructure mounts to the boat at the midship points, extends upward and rearward, and mounts to the boat at a position rearward to the midship points with the support bracket is disclosed where the support bracket includes a mounting surface for mounting to the boat at the rearward position, a stanchion face several times the width of the tubular section to which the bracket is mounted, and a support span between the mounting surface and the stanchion face so that the support bracket distributes compressive force received along the stanchion face through to the mounting surface. Preferably, the support bracket has an arcuate stanchion face mating with the tubular superstructure such that force applied to the superstructure is distributed to the support bracket across the stanchion face. The support bracket preferably is removably secured to the boat and to the superstructure. In a preferred embodiment, the support bracket is attached to the boat and to the superstructure with bolts set a distance from the rearward point of the intersection of the stanchion face and the tubular superstructure so that torque force exerted upon the superstructure is not transmitted through the bolts. Preferably, the support bracket includes mounting points for accessories, and preferably the mounting points include at least one laterally oriented bore in the support bracket for allowing an accessory to be secured through the bore. The bore may be an arcuate slot permitting the secure position of an accessory to be adjusted along the length of the arcuate slot.

In accordance with a third aspect of the preferred embodiment, a method of securing a superstructure to a boat where the superstructure extends above the deck of the boat for towing a person behind the boat is disclosed, the method including providing a boat with at least a pair of generally midship securement points for the superstructure, providing a superstructure with at least a pair of superstructure members for securing to the boat, providing each superstructure member securing to the boat with a mount for securing to the boat, providing the boat with at least a pair of securement points aft of the midship points for mounting support brackets, providing a pair of support brackets each with a boat mounting face for mounting to the boat and a superstructure face for mounting to the superstructure members, setting the faces of the support brackets at an angle for mounting properly the superstructure to the boat, positioning the support brackets on the boat, positioning the superstructure on the superstructure faces of the support brackets, and securing the support brackets, boat, and superstructure so as to be generally mounted. The mounts for securing the superstructure members to the boat may be pivots, and the method may further include pivoting the superstructure members into position for securing. Securing the superstructure may include permanently fixing the position of the superstructure members to the boat. The method may include providing the support brackets with holes, and securing the support brackets includes boring holes in the superstructure and the boat for receiving securement devices through the holes in the support brackets, and the method may further include inserting securement devices through the support brackets and into the superstructure and boat. The securement devices may be bolts. The superstructure members may be tubular, and the superstructure faces may be arcuate, and the method may include mating the superstructure members to the superstructure faces.

In a further aspect, a method is disclosed for replacing a previously installed support bracket. The method may include replacing the previously installed support bracket with a substantially identical support bracket in substantially the identical position as the previous support bracket.

DESCRIPTION OF THE PREFERRED EMBODIMENTS

Figure 1:
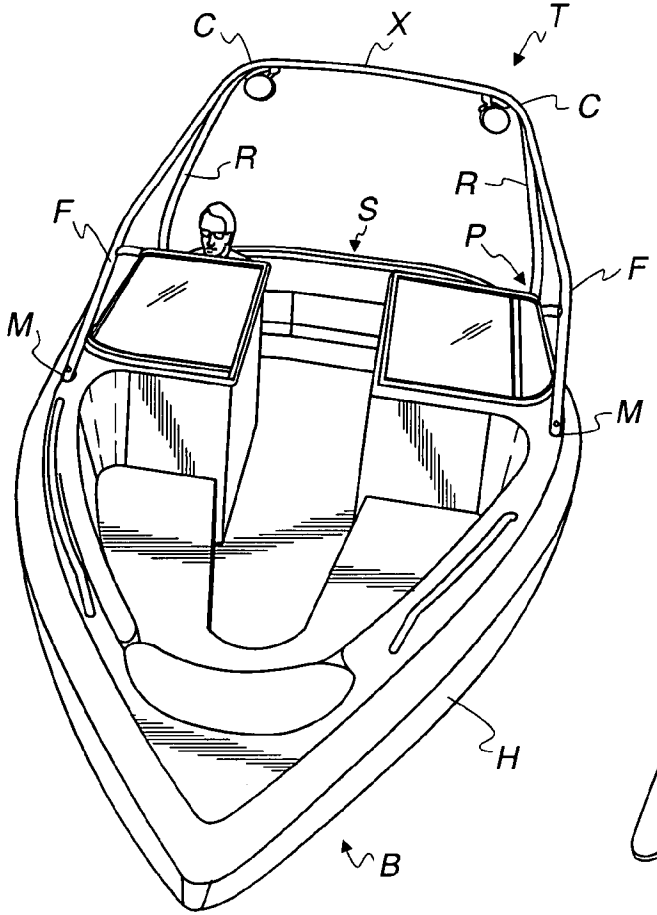
Fig. 1 (Prior Art)
FIG. 1 is a perspective view of a boat with a prior art tower and tower support.

Referring initially to FIG. 1, a prior art design of a boat B with an accompanying tower T is depicted. As can be generally seen, the tower includes lateral side supports including a pair of front stanchion arms F and a pair rear stanchion arms R. The front stanchion arms F are mounted to a general midship point M of the sides of the boat hull H or decking, rise from the point M, and recede towards the stern S of the boat B. The rear stanchion arms R are mounted to a more aft position P on the sides of the boat hull H, rise from the position P, and recede towards the stern S of the boat B. The top-most points of each stanchion arm F, R meets at a crossbar X. Often and as depicted, the front stanchion arms F and the crossbar X are a single piece of metal tubing bent at corners C to form the requisite shape. The rear stanchion arms R then are joined to the front stanchion arms F and the crossbar X at the corners C, typically by welding the end of the rear stanchion arms to the exterior of the metal tubing of the front stanchion arms F and the crossbar X.

In constructing the prior art tower T depicted in FIG. 1, it is required to have accurate placement of the rear stanchion arms R when they are welded. This must be achieved either through careful human monitoring if done by a human which is dangerous, or through using a programmed machine which is expensive. Additionally, the weld seams must be inspected for their integrity and for hydrogen embrittlement (a condition that exists when a surface has too much water present when it is welded that results in a loss of integrity in the material itself). If a weld seam breaks in service, oftentimes the owner may attempt to have it repaired in the field, such as with a portable welding equipment. Recognizing this, a manufacturer can see the safety issues involved in relying on a tower T repaired by someone unfamiliar with welding in a wet or marine environment. Additionally, in repairing or replacing a rear stanchion arm R, one must be careful to ensure the proper height is provided for that side of the tower T: otherwise, the stresses directed through the tower when towing a wakeboarder, for instance, are not distributed properly and can damage the tower T again, or damage the boat B, or result in catastrophic failure through cyclic loading. For stanchion arms mounted to a surface of the boat B, the end of the tubular piece is covered with and welded to a plate set at the proper angle to the arm, and the plate is bolted or secured to the boat B.

Figure 2:
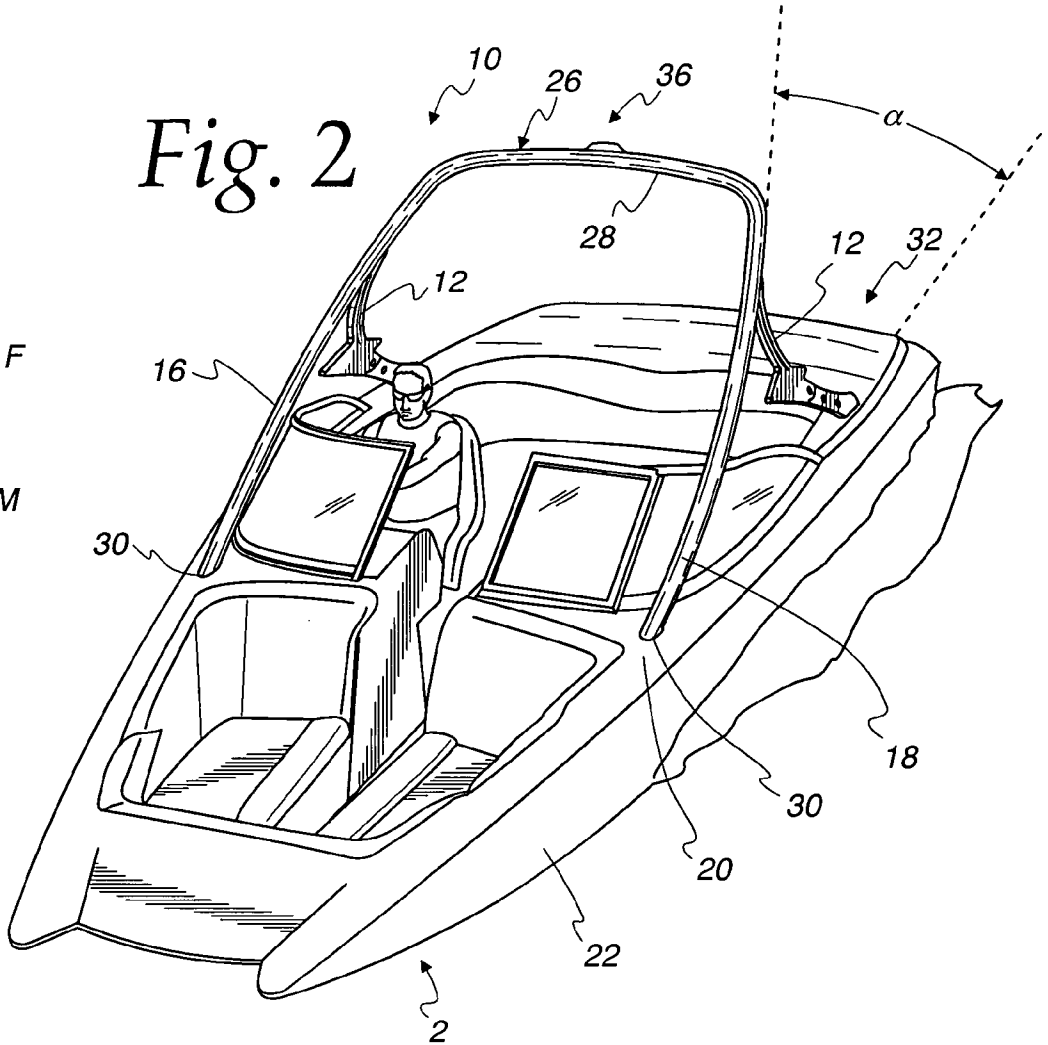
FIG. 2 is a perspective view of a boat with a tower and tower support of an embodiment of the present invention.

Referring now to FIG. 2, an embodiment of the present invention is depicted. Specifically, a boat 2 is depicted with and a tower 10 with tower supports 12. Similarly to the tower T of FIG. 1, the tower 10 has front stanchion arms 16, 18 mounted to sidewalls 20, or the like, of the hull 22 of the boat 2. The front stanchion arms 16, 18 are part of a single tubular metal structure 26 that also forms a crossbar 28. The structure 26 is mounted to the sidewalls 20 at points 30 approximately midship, rises from the points 30, and recedes towards the rear or stern 32 of the boat 2.

The top of the crossbar 28 includes a tow rope mount 36. When the boat 2 is being used for towing a person, preferably a wakeboarder, a tow rope (not shown) is mounted to the tow rope mount 36 to provide both a towing force and a lift force to the wakeboarder.

As a consequence of the geometry of the tower 10 and the intended purpose of providing a lift force to the wakeboarder, a towed wakeboarder exerts a vertical downward force on the crossbar 28, and consequently on the structure 26 and on that to which the structure 26 is joined. Accordingly, as is also shown in the prior art depiction of FIG. 1, it is necessary to provide support to the structure 26.

Therefore, tower supports in the form of brackets 12 are provided for supporting the structure 26. The support brackets 12 are depicted in further detail in FIG. 3. The support brackets 12 span from the sidewalls 20 or hull 22 of the boat 2, for instance, to the front stanchion arms 16, 18. The brackets 12 may be secured in a manner such as exists in the prior art, or, preferably, the brackets 12 are bolted to both the stanchion arms 16, 18 and to the boat 2. The bracket 12 is provided with bolt holes 42 for receiving the bolts. By utilizing bolts, weld seams and their attending difficulties are avoided. In addition, replacing the brackets 12 is a simple procedure. Furthermore, mounting the brackets 12 simply requires proper placement of pilot holes in the stanchion arms 16, 18, and in the boat 2. The proper placement of pilot holes by humans is simple, safe, and devoid of expensive equipment.

The support brackets 12 includes a stanchion mount face 44, and a boat mount face 46. Each face is prepared so that, when installed, the proper angle $\alpha$ is provided between the structure 26 and the boat 2 (see FIGS. 2 and 3). Often, the tower 10 is constructed so that it may be lower by means of pivots at the mounting points 30. When brackets 12 are installed or replaced, the tower may be pivoted upward while the brackets 12 are moved along the surface to which it is to be mounted to the boat until reaching a point where the stanchion mount face 44 and the boat mount face 46 are flush against the proper surfaces of the boat 2 and the stanchion arms 16, 18. Instead of utilizing a cut portion of a hollow tube for attaching a support to the stanchion arms, like the prior art device discussed above, the stanchion mount face 44 of the support bracket 12 is arcuate (FIG. 4) and abuts the surface of one of the stanchion arms 16, 18. This provides a secure, flush, and precise mount between the stanchion arms 16, 18 and a bracket 12, and provides a mounting area several times the diameter of the stanchion arms 16, 18. Additionally, the bolt holes 42 along the stanchion mount face 44 are positioned a distance from a rear end 48 of the stanchion mount face 44. As cyclic loading is applied to the tower 10, the stanchion arms 16, 18 are torqued against the rear end 48. In such an arrangement, the torquing is not borne by the weld seam that would normally be present in a prior art tower assembly at the intersection of a support and a stanchion arm. The boat mount face 46 may have a flat surface, as is depicted in FIG. 4, for abutting a surface of the boat 2, or another shape if deemed desirable.

Figure 3:
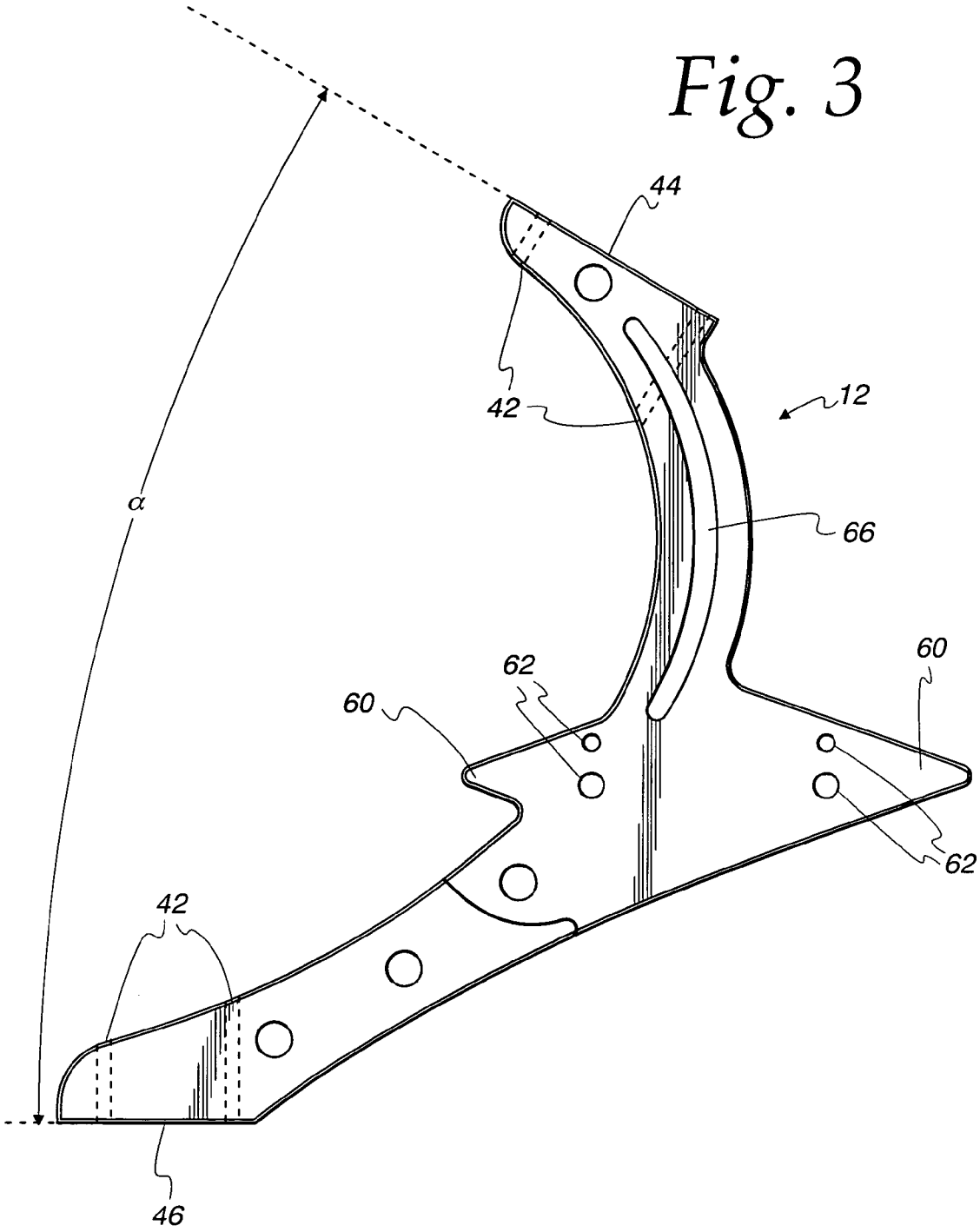
FIG. 3 is a side elevation view of the tower support of the embodiment of FIG. 2.
Figure 4:
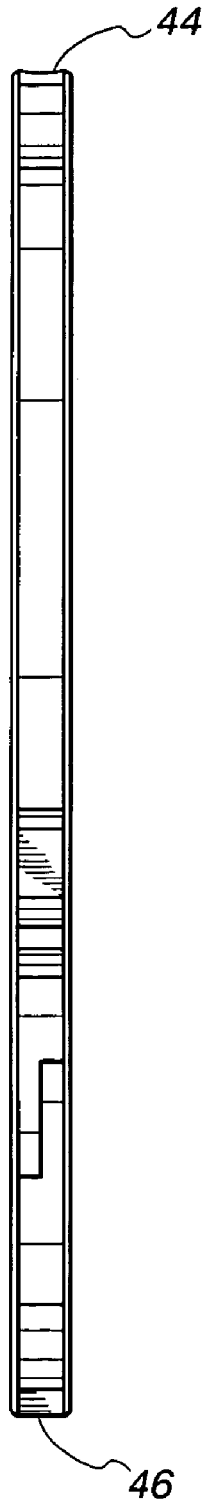
FIG. 4 is a rear elevation view of the tower support of FIG. 3.

As can be seen in FIG. 3, the bracket 12 has flares 60 and bores 62. In the prior art embodiments, attaching accessories or devices for storing accessories involved clamping or bracketing items to the tubular tower T. As the geometry of the stanchion arms of the prior art embodiments is such that the arms rise at an angle, it is complicated to mount securely and conveniently items to the stanchion arms and the tower T. In the present embodiment, the flares 60 provide an area that has minimal effect upon the load bearing capacity of the tower 10 while also providing bores 62 for receiving mounting fixtures of accessory devices and the like.

In addition, the bracket 12 has an arcuate passage 66. The passage 66 is positioned and shaped to minimize its effect upon the load bearing capacity of the tower 10, as can be seen in FIG. 3. The passage 66 allows a screw clamp (not shown) to be inserted therethrough for securing an item where the position of the screw clamp can be readily adjusted along the length of the passage 66.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A support for a superstructure mounted to a surface of a vehicle that is used for a towing a person on a surface where the superstructure includes a member providing a lift force to the person, the support comprising:

a mounting surface for mounting to the surface of the vehicle;

a stanchion face several times the width of the superstructure and for mounting to the superstructure; and a bracket length spanning from the mounting surface to the stanchion face, wherein the bracket distributes compressive force received along the stanchion face through to the mounting surface, and wherein the stanchion face mounts to an arcuate portion of the superstructure and includes an arcuate surface mating with the arcuate portion.

2. A support for a superstructure mounted to a surface of a vehicle that is used for a towing a person on a surface where the superstructure includes a member providing a lift force to the person, the support comprising:

a mounting surface for mounting to the surface of the vehicle;

a stanchion face several times the width of the superstructure and for mounting to the superstructure; and a bracket length spanning from the mounting surface to the stanchion face, wherein the bracket distributes compressive force received along the stanchion face through to the mounting surface, and wherein the support can be removed or replaced without altering the superstructure.

3. The support of claim 2 further including bolts and bolt holes wherein the bolts are positioned within the bolt holes for securing the support to the vehicle and to the superstructure.

4. A support bracket in combination with a vehicle having a front end, a rear end, two midpoints, and a tubular superstructure where the superstructure mounts to the vehicle at the midpoints, extends upward and rearward, and mounts to the vehicle at a position rearward to the midpoints with the support bracket, the support bracket comprising:

a mounting surface for mounting to the vehicle at the rearward position;

a stanchion face several times the width of the tubular section to which the bracket is mounted; and a support span between the mounting surface and the stanchion face, wherein the support bracket distributes compressive force received along the stanchion face through to the mounting surface.

5. The combination of claim 4 wherein the support bracket has an arcuate stanchion face mating with the tubular superstructure such that force applied to the superstructure is distributed to the support bracket across the stanchion face.

6. The combination of claim 4 wherein the support bracket is removably secured to the vehicle and to the superstructure.

7. The combination of claim 6 wherein the support bracket is attached to the vehicle and to the superstructure with bolts set a distance from the rearward point of the intersection of the stanchion face and the tubular superstructure so that torque force exerted upon the superstructure is not transmitted through the bolts.

8. The combination of claim 4 wherein the support bracket includes mounting points for accessories.

9. The combination of claim 8 wherein the mounting points include an at least one laterally oriented bore in the support bracket for allowing an accessory to be secured through the bore.

10. The combination of claim 9 wherein the bore is an arcuate slot permitting the secure position of an accessory to be adjusted along the length of the arcuate slot.

11. A method of securing a superstructure to a vehicle where the superstructure extends above a surface of the vehicle for towing a person behind the vehicle, the method including:

providing a vehicle with at least a pair of generally midpoint securements for the superstructure;

providing a superstructure with at least a pair of superstructure members for securing to the vehicle;

providing each superstructure member securing to the vehicle with a mount for securing to the vehicle;

providing the vehicle with at least a pair of securement points rearward of the midpoint securements for mounting support brackets;

providing a pair of support brackets each with a vehicle mounting face for mounting to the vehicle and a superstructure face for mounting to the superstructure members;

setting the faces of the support brackets at an angle for mounting properly the superstructure to the vehicle;

positioning the support brackets on the vehicle;

positioning the superstructure on the superstructure faces of the support brackets; and securing the support brackets, vehicle, and superstructure so as to be generally mounted.

12. The method of claim 11 wherein the mounts for securing the superstructure members to the vehicle are pivots, and the method further includes pivoting the superstructure members into position for securing.

13. The method of claim 11 wherein the securing the superstructure includes permanently fixing the position of the superstructure members to the vehicle.

14. The method of claim 11 wherein the method includes providing the support brackets with holes, and securing the support brackets includes boring holes in the superstructure and the vehicle for receiving securement devices through the holes in the support brackets, and the method further includes inserting securement devices through the support brackets and into the superstructure and vehicle.

15. The method of claim 14 wherein the securement devices are bolts.

16. The method of claim 11 wherein the superstructure members are tubular and superstructure faces are arcuate, and the method includes mating the superstructure members to the superstructure faces.

17. The method of claim 16 further including removing a previously installed support bracket.

18. The method of claim 17 wherein the method includes replacing the previously installed support bracket with a substantially identical support bracket in substantially the identical position as the previous support bracket.

* * * * *

UNITED STATES PATENT AND TRADEMARK OFFICE

CERTIFICATE OF CORRECTION

PATENT NO. : 6,925,957 B2
DATED : August 9, 2005
INVENTOR(S) : Schultz, James

It is certified that error appears in the above-identified patent and that said Letters Patent is hereby corrected as shown below:

Column 6,
Lines 16 and 31, after "for" delete "a".

Signed and Sealed this

Fifteenth Day of November, 2005

JON W. DUDAS
*Director of the United States Patent and Trademark Office*